United States Patent [19]

Baczek et al.

[11] 4,391,844

[45] Jul. 5, 1983

[54] METHOD FOR MAKING LININGS AND COATINGS FROM SOLUBLE CROSS-LINKABLE PERFLUOROCARBON COPOLYMERS

[75] Inventors: Stanley K. Baczek; G. Howard McCain, both of Painesville; Leo L. Benezra, Mentor; Michael J. Covitch, Cleveland Hts., all of Ohio

[73] Assignee: Diamond Shamrock Corporation, Dallas, Tex.

[21] Appl. No.: 277,920

[22] Filed: Jun. 26, 1981

[51] Int. Cl.[3] ..... B05D 3/06; B05D 3/02

[52] U.S. Cl. ..... 427/44; 427/236; 427/238; 427/239; 427/385.5; 427/388.2; 427/388.5; 524/236; 524/288; 524/319; 524/341

[58] Field of Search ..... 427/388.2, 388.5, 230, 427/236, 238, 239, 44, 54.1, 385.5; 204/159.2; 260/31.2 R, 32.6 PQ, 32.6 R, 33.4 F, 33.8 F; 264/270, 269, 267; 138/143, 145, DIG. 3; 526/243; 525/903, 189; 521/27, 28, 33; 524/236, 288, 319, 341

[56] References Cited

U.S. PATENT DOCUMENTS

| | | | |
|---|---|---|---|
| 4,189,369 | 2/1980 | Fang | 521/33 X |
| 4,294,943 | 10/1981 | Onove et al. | 521/33 X |
| 4,323,603 | 4/1982 | Close | 427/407.2 X |

FOREIGN PATENT DOCUMENTS 2014585A of 0000 United Kingdom .

*Primary Examiner*—Norman Morgenstern
*Assistant Examiner*—Thurman K. Page
*Attorney, Agent, or Firm*—Woodrow W. Ban

[57] ABSTRACT

Coatings made from soluable cross-linkable elastomers are shown. Particularly, techniques for solution cross-linking perfluorocarbon copolymers to generate resistant coatings for lining and coating applications are disclosed.

12 Claims, No Drawings

METHOD FOR MAKING LININGS AND COATINGS FROM SOLUBLE CROSS-LINKABLE PERFLUOROCARBON COPOLYMERS

TECHNICAL FIELD

This invention relates to resistant structures, coatings or liners and to methods for applying these coatings or liners. More specifically, this invention relates to cross-linkable copolymeric, primarily perfluorocarbon, coatings or liners and to methods for their application.

BACKGROUND OF THE INVENTION

A number of materials are available for fabricating structures, coatings and liners for use in, particularly, corrosive applications. Among these materials are resins such as polyvinyl chloride, polypropylene, and chlorinated polyvinyl chloride, all available commercially in a large variety of grades. These resins, while providing generally satisfactory resistance to many acids and organics, can be susceptible to attack where even small quantities of certain organics such as benzene or chorinated benzenes are present. Other resins, such as Teflon ®, a product of E. I. duPont available as either hexafluoropropylene copolymer (FEP) or tetrafluoroethylene (TFE), and Kynar ®, polyvinylidene fluoride, available from Pennwalt have been used for structures, liners and coatings but, upon occasion, have experienced difficulty. For example, TEFLON coatings are somewhat porous, requiring a substantial thickness to protect an underlying substrate reliably. KYNAR, in some applications, has show swelling and resultant delamination when used for coating.

Rubber and synthetic rubbers such as Hypalon ® and Viton-A ®, E. I. duPont products, have been used for corrosion resistant structures, coatings and liners but remain subject to swelling and delamination in the presence of certain corrosives and in the presence of even trace quantities of certain organics.

One group of contemporary copolymers offering potentially gratifying advantages when used for forming corrosion resistant structures, coatings and linings are the fluorocarbon vinyl ether copolymers having pendant functional groups based upon $SO_2$ halide and CO halide known generally as perfluorocarbons and marketed by E. I. duPont under the name Nafion.

These so-called perfluorocarbons are generally copolymers of two monomers with one monomer being selected from a group including vinyl fluoride, hexafluoropropylene, vinylidene fluoride, trifluoroethylene, chlorotrifluoroethylene, perfluoro(alkylvinyl ether), tetrafluoroethylene and mixtures thereof.

The second monomer is selected from a group of monomers containing an $SO_2F$ or sulfonyl fluoride group. Examples of such second monomers can be generically represented by the formula $CF_2{=}CFR_1SO_2F$. $R_1$ in the generic formula is a bifunctional perfluorinated radical comprising one to eight carbon atoms. One restraint upon the generic formula is a general requirement for the presence of at least one fluorine atom on the carbom atom adjacent the $-SO_2F$, particularly where the functional group exists as the $-(-SO_2NH)mQ$ form. In this form, Q can be hydrogen or an alkali or alkaline earth metal cation and m is the valence of Q. The $R_1$ generic formula portion can be of any suitable or conventional configuration, but it has been found preferably that the vinyl radical comonomer join the $R_1$ group through an ether linkage.

Typical sulfonyl fluoride containing monomers are set forth in U.S. Pat. Nos. 3,282,875; 3,041,317; 3,560,568; 3,718,627 and methods of preparation of intermediate perfluorocarbon copolymers are set forth in U.S. Pat. Nos. 3,041,317; 2,393,967; 2,559,752 and 2,593,583. These perfluorocarbons generally have pendant $SO_2F$ based functional groups.

These perfluorocarbons, while demonstrating significant resistance to most conventional corrosives, and substantial resistance to swelling in the presence of most conventional organic compounds, are none-the-less hydrophilic following hydrolysis. Typically these perfluorocarbons are used as cationic exchange materials and are therefore relatively readily permeable to cations. Where a substrate vulnerable to cation related corrosive attack is to be protected, this cation permeability and hydrophilic nature become undesirable.

Cation permeability of NAFION and hydrophilic properties are preponderately related to the functional group $SO_2F$ and/or its derivatives. Typical derivatives include $SO_2Cl$, $SO_3^-Z^+$ where $Z^+$ is any alkali or alkaline metal cation, a quaternary ammonium ion or salt and hydrogen and $SO_2O$-ester. Were the functional groups to be modified to reduce the hydrophilic nature of the NAFION, a chemically resistant, highly nonporous coating and lining material would result.

DISCLOSURE OF THE INVENTION

The present invention provides a method for making a solution-applied perfluorocarbon copolymeric material. By the method, at least the perfluorocarbon copolymer is dispersed in a solvating dispersion media heated to solvate at least a substantial portion of the dispersed copolymer. The dispersion is contacted with a cross-linking initiator; this initiator contact may be accomplished either prior to or subsequent to application of the dispersion. Following application, the dispersion media is removed using at least one of heat, vacuum and a solvent.

The cross-linking initiator is generally one of two types. In one initiator type, at least one chemical initiator is dispersed in a media generally compatible with that dispersion media dispersing the perfluorocarbon copolymer. This second dispersion is generally admixed with the perfluorocarbon dispersion prior to application but equally can be introduced into previously applied perfluorocarbon dispersion. The second initiator type is irradiation, generally directed to the perfluorocarbon dispersion subsequent to application but equally directable to the perfluorocarbon dispersion prior to application. From time to time, it may be advantageous to utilize both chemical and an irradiation type initiators.

In an equally preferred alternate to the instant invention, a further cross-linkable polymer accompanies the perfluorocarbon copolymer in the dispersion. Upon contact with the cross-linking initiator, this second polymer undergoes cross-linking either with itself or with both itself and the perfluorocarbon copolymer to yield an interpenetrating polymer network of the perfluorocarbon copolymer and the further cross-linkable polymer.

Cross-linked perfluorcarbon prepared in accordance with the instant invention and applied to a suitable substrate provides a substantially nonporous, effective coating or liner upon the substrate substantially resistant to most corrosive chemicals and organics. When formed into structures, the cross-linked copolymeric perfluorocarbon results in a chemically resistant structure having surprising dimensional stability in many aggressive organic solvents.

The above and other features and advantages of the invention will become apparent when considered with the following detailed description of the invention and illustrative examples which form a part of the specification.

BEST EMBODIMENT OF THE INVENTION

The present invention comprises a method for making a solution-applied perfluorocarbon copolymeric material. In preferred embodiments, the material is useful for applying coatings and liners to substrates. Applied, the material provides desirable protection for these substrates from corrosive and many aggressive solvents. When used to fabricate structures, the material provides a resulting structure resistant to many aggressive solvents and relatively dimensionally stable in those solvents.

In the best embodiments, the perfluorocarbon copolymer is a vinyl ether copolymer having pendant functional groups such as NAFION, marketed by E. I. duPont.

The perfluorocarbon utilized in the instant invention desirably should be available as an intermediate copolymer having pendant generally nonionic functional groups which can be readily utilized or converted to cross-linking sites. However, the perflurocarbon is more generally available, often in sheet form having these pendant functional groups converted to provide active ion exchange sites. These sites on the final copolymer provide ion exchange functional utility of the perfluorocarbon copoymer making it useful for cation exchange membranes and giving the copolymer hydrophilic properties.

The intermediate polymer is prepared from at least two monomers that include fluorine substituted sites. At least one of the monomers comes from a group that comprises fluorinated vinyl fluoride, hexafluoropropylene, vinylidene fluoride, trifluoroethylene, chlorotrifluoroethylene, perfluoro(alkyl vinyl ether), tetrafluoroethylene and mixtures thereof.

At least one of the monomers comes from a grouping having members with functional groups capable of imparting cationic exchange characteristics to the final copolymer. Monomers containing pendant sulfonyl, carbonyl or, in some cases phosphonic acid based functional groups are typical examples. Esters, amides or salts based upon the same functional groups can also be utilized.

Among the preferred families of monomers, in the second grouping are sulfonyl containing monomers containing the precursor functional group $SO_2X$ where X is a halide, usually fluorine or chlorine. Examples of members of such a family can be represented by the generic formula of $CF_2{=}CFSO_2F$ and $CF_2{=}CFR_1SO_2F$ where $R_1$ is a bifunctional perfluorinated radical comprising 2 to 25 carbon atoms and usually 2 to 8 carbon atoms.

The particular chemical content or structure of the perfluorinated radical linking the sulfonyl group to the copolymer chain is not critical and may have fluorine, chlorine or hydrogen atoms attached to the carbon atoms to which the sulfonyl group is attached, although the carbon atom to which the sulfonyl group is attached must also have at least one fluorine atom attached. Preferably the monomers are perfluorinated. If the sulfonyl group is attached directly to the chain, the carbon in the chain to which it is attached must have a fluorine atom attached to it. The $R_1$ radical of the formula above can be either branched or unbranched, i.e., straight chained, and can have one or more ether linkages. It is preferred that the vinyl radical in this group of sulfonyl fluoride containing comonomers be joined to the $R_1$ group through an ether linkage, i.e., that the comonomer be of the formula $CF_2{=}CFOR_1SO_2X$. Illustrative of such sulfonyl halide containing comonomers are:

$$CF_2{=}CFOCF_2CF_2SO_2X,\ CF_2{=}CFOCF_2\underset{\underset{CF_3}{|}}{C}FOCF_2CF_2SO_2X,$$

$$CF_2{=}CFOCF_2\underset{\underset{CF_3}{|}}{C}FOCF_2\underset{\underset{CF_3}{|}}{C}FOCF_2CF_2SO_2X,$$

$$CF_2{=}CFCF_2CF_2SO_2X,\ \text{and}\ CF_2{=}CFOCF_2\underset{\underset{\underset{\underset{CF_3}{|}}{O}}{\underset{CF_2}{|}}}{C}FOCF_2CF_2SO_2X$$

The corresponding esters, amides and sulfonates of the aforementioned sulfonyl halides can equally be used.

While the preferred intermediate copolymers are perfluorocarbon, that is perfluorinated, others can be utilized where there is a fluorine atom attached to the carbon atom to which the sulfonyl group is attached. A highly preferred copolymer is one of tetrafluoroethylene and perfluoro(3,6-dioxa-4-methyl-7-octenesulfonyl fluoride) comprising between 10 and 60 weight percent, and preferably between 25 and 40 weight percent, of the latter monomers.

These perfluorinated copolymers may be prepared in any of a number of well-known manners such as is shown and described in U.S. Pat. Nos. 3,041,317; 2,393,967; 2,559,752 and 2,593,583.

For its more traditional end uses, an intermediate copolymer is readily transformed into a copolymer containing ion exchange sites by conversion of the sulfonyl halide groups ($-SO_2F$, $SO_2Cl$ or $-SO_3$ alkyl) to the form $-SO_3Z$ by saponification or the like wherein Z is hydrogen; an alkali metal such as lithium, sodium, potassium, rubidium and cesium; a quaternary amine; or an alkaline earth metal such as beryllium, magnesium, calcium, strontium and barium. The converted copolymers contains sulfonyl group based ion exchange sites contained in side chains of the copolymer and attached to carbon atoms having at least one attached fluorine atom. Not all sulfonyl groups within the intermediate copolymer need be converted. The conversion may be accomplished in any suitable or customary manner such as is shown in U.S. Pat. Nos. 3,770,547 and 3,784,399.

Sulfonamides, sulfonates, and sulfonate esters of sulfonyl halide copolymer are relatively readily reconverted to an $SO_2F$ functionality by contact with $SF_4$ and a catalyst such as HF, both in substantial molar excess under generally autogenous pressure at temperatures between $-20°$ C. and 200° C. under anhydrous conditions. Reconverted, the intermediate copolymer having $SO_2F$ functionality may be used in implementing instant invention.

Copolymeric perfluorocarbon having pendant carbonyl based cationic exchange functional groups can be prepared in any suitable or conventional manner such as in accordance with U.S. Pat. No. 4,151,053 or Japanese patent application No. 52(1977)38486 or polymerized from a carbonyl functional group containing monomer derived from a sulfonyl group containing monomer by a method such as is shown in U.S. Pat. No. 4,151,053. Preferred carbonyl containing monomers include $CF_2{=}CF{-}O{-}CF_2CF(CF_3)O(CF_2)COOCH_3$ and $CF_2{=}CF{-}O{-}CF_2CF(CF_3)O(CF_2)COOCH_3$. Perfluorocarbons polymerized from these monomers can be satisfactorily utilized in the instant invention.

Perfluorocarbon copolymer is dispersed in any suitable or conventional manner. Preferably relatively finely divided particles of the copolymer are used to form the dispersion. The particles are dispersed in a dispersion medium that preferably has significant capability for solvating the perfluorocarbon copolymer particles. A variety of solvating dispersers have been discovered for use as a dispersion media for the perfluorocarbon copolymer; these suitable solvating dispersion media are tabulated in Table I and coordinated with the copolymer pendant functional grops with which they have been found to be an effective disperser. While each Table I dispersion medium alone can provide effective dispersion, use of one or more in a mixture or in a mixture with a suitable or conventional diluant is feasible. Therefore, the term dispersion media is used to indicate a suitable or conventional solvating dispersing agent including at least one solvating medium.

TABLE I

SOLVENT CROSS REFERENCE TO PERFLUOROCARBON COPOLYMER CONTAINING VARIOUS PENDANT FUNCTIONAL GROUPS

| | FUNCTIONAL GROUP | |
|---|---|---|
| SOLVENT | $SO_2F$ | COF, $CO_2R$ |
| Halocarbon Oil | X | X |
| perfluorooctanoic acid | X | X |
| perfluorodecanoic acid | X | X |
| perfluorotributylamine | X | X |
| FC-70 available from 3M, a perfluoroalkylamine | X | X |
| perfluoro-1-methyldecalin | X | X |
| decafluorobiphenyl | X | X |
| pentafluorophenol | X | X |
| pentaflurorobenzoic acid | X | X |

Halocarbon Oil is a commercially marketed oligomer of chlorotrifluoroethylene.
R is a short chain alkane of 5 carbons or less.

At elevated temperatures, the dispersion media of Table I possess substantial capability for solvating the perfluorocarbon copolymers. Preferably the copolymer is dissolved substantially completely for use in the instant invention. At temperatures of between 200° C. and 275° C., the solvating dispersion media of Table I can dissolve between about 5 weight percent and 30 weight percent of the perfluorocarbon copolymers. Resulting solutions vary depending upon the solvent, from clear to murky brown. Maximum dispersion temperature will generally be limited by the boiling point of the resulting dispersion.

It is not necessary that complete solvation result. Where an intermediate position in a sol-gel system approaching substantial solution is reached, and where remaining undissolved perfluorocarbon copolymer is quite finely divided, the resulting dispersion can be utilized in the instant invention with substantial confidence.

It is believed that other suitable or conventional perhalogenated compounds can be used for at least partially solvating $SO_2F$ or COF or $CO_2R$ forms of perfluorocarbon copolymer.

The functional groups pendant from the copolymeric perfluorocarbon and normally utilized to provide cation exchange functionality are available to perform as sites for cross-linking between adjacent copolymeric perfluorocarbons. Cross-linking can be accomplished in any suitable or conventional manner such as by irridation or through the use of chemical initiators.

Radiation where used as the initiator may be applied to the perfluorocarbon dispersion either shortly prior to application of the dispersion or shortly thereafter in any suitable or conventional manner. While even small quantities of radiation will produce cross-linking action in the copolymer, it is desirable that at least 0.25 Megarads of radiation be used and preferably about 1.5 Megarads for 1100 equivalent weight perfluorocarbon comprising a 25 percent by weight solution in Halocarbon Oil.

Where radiation is used for cross-linking initiation, it is much preferred that at least one further cross-linkable polymer be included in the copolymeric perfluorocarbon dispersion. This further polymer undertakes cross-linking with itself, and depending upon both the nature of the further copolymer and conditions such as temperature and the like, with the perfluorocarbon copolymer. These multiple polymer type cross-linked structures are known generally as interpenetrating polymer networks.

Further polymers suitable for use in these interpenetrating networks include polyethylene, polypropylene and VITON-A. Other suitable or conventional relatively readily cross-linkable copolymers soluble in the perfluorocarbon copolymer dispersion can also be utilized.

In a preferred alternate, the initiator functions chemically to promote cross-linking between perfluorocarbon copolymers. One or more initiators, dissolved in a dispersion media compatible with the perfluorocarbon copolymer dispersion is admixed with the perfluorocarbon dispersion. Admixture can be accomplished in any suitable or conventional manner such as by suitably modified conventional spraying equipment used for applying foamed in place 2 part urethanes. Admixture preferably is accomplished prior to application of the perfluorocarbon copolymeric dispersion but can occur subsequent to dispersion application.

A number of initiators are available for use in the instant invention including MgO, thiuramdisulfide, dicumylpenoxide, sodium disulfide, sulfur and ethylenediamine carbamate. Other suitable or conventional initiators can be utilized. These initiators may be used in conjunction with either radiation and or further cross-linkable polymers such as VITON-A, polyethylene, and polypropylene.

Preferably subsequent to contacting the initiator, the perfluorocarbon dispersion is maintained at elevated temperatures generally greater than 150° C. but less than 300° C. during completion of a substantial portion of any cross-linking activity. This elevated temperature speeds cross-linking activity. Generally subsequent to, but in some instances cocurrently with the cross-linking activity, the dispersion media is removed. Heat and/or vacuum are useful for removal of the dispersion media, with the vacuum, where used, preferably increasing as dispersion media is removed. Alternately the dispersion media may be leacked out in a suitable or conventional manner using acetone, 2-propanol, Freon, that is halogenated hydrocarbons such as Freon 113, or other suitable or conventional dispersion media solvent.

Once applied to a substrate and cross-linked, the perfluorocarbon provides an advantageous protective coating. Cross-linking substantially reduces hydrophilic characteristics of the perfluorocarbon copolymer generally attributable to hydrolyzed derivatives of the $SO_2$ halide or CO halide pendant functionality. In addition, cross-linking tends to render applied coatings less porous and more stable both chemically and dimensionally thereby improving coating performance where coatings of quite slender thickness are applied.

Cross-linking initiators are believed to act in a conventional manner well-known in the art despite the presence of the dispersing media. Depending upon the initiators utilized, a number of cross-linking structures may result, all generally being characterized by the structure $—OCF_2CF_2Y—B—YCF_2CF_2O—$ where Y is $SO_2$ or CO and B is a cross-linking structure of the form, $S_x—O—O—$, and di and poly amines of a form $—NH(CR_1R_2)_xNH—$ with $R_1$ and $R_2$ being hydrogen, halogen, an amine group and short chain alkanes, alkenes, and amines of generally 5 carbon atoms or less. The $S_x$ structure will be generally between 1 and 12 sulfur atoms with 2 to 4 being preferred.

While these cross-linking structures will tend to reduce the hydrophilic nature of the coating and its ion exchange capability, generally the poly and di amine linkages and the $S_x$ linkages are preferred where the coating is to perform is particularly aggressive environments. Particularly the $S_x$ linkage structure is preferred.

Following contact with the cross-linking initiator, the dispersion media can be removed in any suitable or conventional manner. Heat, but not in excess of about 275° C., vacuum or a combination of both can be used or solvent extraction using acetone, 2-propanol, halogenated hydrocarbons such as Freon 113, a duPont product, or the like, can be employed. Removal can accompany cross-linking or be abeyed pending completion of cross-linking activity. Where vacuum is used, it is preferred that the vacuum increase as removal of dispersion media nears completion. Leaching with solvent is also useful.

Where a structure has been formed by molding or the like, the dispersion media can be partially or completely removed prior to removing the structure from the mold, with any remaining dispersion media being subsequently removed. Leaching with solvent or heat with vacuum may be satisfactorily employed.

Dispersion containing the copolymeric perfluorocarbon can be applied to a substrate in any suitable or convention manner such as by brushing, rollering or spraying. Where sprayed, it is oftene convenient to admix the perfluorocarbon dispersion and a dispersion containing any initiators at the spray nozzle or to apply the dispersions sequentially in rapid succession so as to produce an admixture upon the coated substrate. Systems are available commercially for making such applications, including those capable of handling heated dispersions.

The following examples are offered to further illustrate the features and advantages of the invention.

EXAMPLE I

Perfluorinated copolymer having sulfonyl fluoride pendant functionality and an equivalent weight of 1100 is dissolved in Halocarbon Oil grade 11-14 at 230° C. in a ratio of 100 grams of the copolymer and 300 grams Halocarbon Oil. Separately 15 grams of MgO and 0.25 gram of ethylene diamine carbamate are dispersed in 50 grams of Halocarbon Oil grade 11-14, also at 230° C. The dispersions are admixed in a ratio of about 8 parts perfluorocarbon dispersion to one part initiator dispersion at a spray nozzle and sprayed at about 2000 psi onto a steel substrate prepared by etching with HCl (18° Be). After application, the dispersion media is removed at 200° C. under steadily increasing vacuum over 16 hours until 20 millimeters of vacuum is attained. A resistant impervious coating results.

EXAMPLE II

The coating of Example I is prepared except including 20 grams of VITON-A in the perfluorocarbon dispersion. An interpenetrating polymeric network structure results, producing a resistant coating.

EXAMPLE III

Approximately 100 grams of 1100 equivalent weight perfluorocarbon copolymer having pendant sulfonyl chloride functionality is dispersed in 300 grams of grade 11-14 Halocarbon Oil at 230° C. Separately 15 grams MgO is dispersed in 45 grams of Halocarbon Oil grade 11-14. The dispersions are admixed and applied as in Example I. The resulting coating is resistant to most agressive organics, acids and bases.

EXAMPLE IV

The coating preparation of Example III is repeated except including 0.5 gram tetramethyl thiuramdisulfide in dispersion with the MgO. A highly resistant coating results.

EXAMPLE V

The perfluorocarbon dispersion of Example III is admixed with a dispersion of 0.5 gram MgO and 5 grams powered flowers of sulfur in Halocarbon Oil grade 11-14. Admixture occurs at 250° C., with application being in accordance with Example I to produce a durable, resistant coating.

EXAMPLE VI

A dispersion is formed using 100 grams of 1100 equivalen weight copolymeric perfluorocarbon having pendant $SO_2Cl$ functionality and 20 grams of low density polyethylene in 300 grams of perfluorooctanoic acid at 230° C. One gram of $(CH_3)_2NCS—S—S—S—CN(CH_3)_2$ is blended into the dispersion which is immediately rolled onto an HCl (18° Be) etched steel substrate. Dispersion media is then removed in accordance with Example I to leave a resistant, durable coating.

EXAMPLE VII

The dispersion of Example VI, absent the $(CH_3)_2NC—S—S——S—CN(CH_3)_2$, is applied by spraying to an HCl (18° Be) etched steel substrate. 1.5 M rad of radiation is then applied to the dispersion. Disperion media is removed in accordance with Example I to leave a resistant coating.

EXAMPLE VIII

A dispersion of 100 grams of 1100 equivalent weight copolymeric perfluorocarbon having pendant $SO_2F$ functionality is dispersed in 300 grams of Halocarbon Oil grade 11–14. This dispersion is admixed with a 20 weight percent slurry of finely divided $NaS_2$ in Halocarbon Oil grade 11–14 in a ratio of 8 parts to 1 as the dispersion is applied to an HCl (18° Be) etched steel substrate. After removal of the dispersion media in accordance with Example I, a tough, durable coating results resistant the many acids, basis and aggressive solvents.

EXAMPLE IX

Example IV is repeated using 5 grams finely divided flowers of sulfur in lieu of the MgO. A tough, durable coating results after removal of the Halocarbon Oil.

While a preferred embodiment of the invention has been shown in detail, it should be apparent that various alterations and modifications can be made to the invention as disclosed without departing from the scope of the claims following.

What is claimed is:

1. A method for coating a substrate with a soluabilized cross-linkable perfluorocarbon copolymer having pendant sulfonyl halide functional groups and polymerized from at least two monomers, one such monomer consisting essentially of at least one fluorinated vinyl compound and the other monomer consisting essentially of at least one monomer having the structure:

$$CF_2{=}CFA,\ CF_2{=}CFR_1A,\ CF_2{=}CFOR_1A$$

with $R_1$ being a bifunctional perfluorinated radical having between 2 and 25 carbon atoms, which carbon atoms being at least once interruptable by one or more oxygen atoms and A being one of sulfonyl fluoride and sulfonyl chloride comprising the steps of:

dispersing the copolymeric perfluorocarbon in a solvating dispersion media selected from a group consisting of Halocarbon Oil, perfluorooctanic acid, perfluorodecanoic acid, perfluorotributyl amine, perfluoro-1-methyldecalin, decafluorobiphenyl, pentafluorophenol and pentafluorobenzoic acid, heating the dispersion to a temperature between about 200° C. and 275° C. whereby substantially all perfluorocarbon copolymer solvates;

applying the admixed dispersions to the substrate;

irradiating the applied copolymer to initiate cross-linking; and removing the dispersion media using at least one of heat and vacuum.

2. The method of claim 1, a second cross-linkable polymer being dispersed with the perfluorocarbon copolymer.

3. The method of claim 2 wherein the second cross-linkable polymer is selected from a group consisting of polyethylene, polypropylene and VITON-A.

4. A method for making a solution applied perfluorocarbon copolymeric material for use in protective coatings and linings and for use in resistant structures comprising the steps of:

dispersing in a solvating dispersion media a copolymeric perfluorocarbon having at least one sulfonyl halide and carbonyl halide based pendant functional groups and polymerized from at least two monomers, one such monomer consisting essentially of at least one fluorinated vinyl compound and the other monomer consisting essentially of at least one monomer having the structure:

$$CF_2{=}CFA,\ CF_2{=}CFR_1A,\ CF_2{=}CFOR_1A$$

with $R_1$ being a bifunctional perfluorinated radical having between 2 and 25 carbon atoms, which carbon atoms being at least once interruptable by one or more oxygen atoms and A being selected from a group consisting of sulfonate ester, sulfonyl halide, sulfonamide, saponification products of sulfonyl halide, carboxylate ester, carbonyl halide and saponification products of carbonyl halide; the dispersion being heated until substantially all of the perfluorocarbon becomes solvated;

dispersing at least one cross-linking initiator in a compatible dispersion media;

admixing the dispersions immediately prior to application; and removing the dispersion media using at least one of heat and vacuum subsequent to application.

5. The method of claim 4 wherein the cross-linking initiator is selected from a group consisting of MgO, ethylene diamine carbamate, sodium difulfide, thiuramdisulfide, sulfur, dicumylperoxide.

6. The method of claim 4, a second cross-linkable polymer being dispersed with the perfluorocarbon copolymer.

7. The method of claim 6 wherein the second cross-linkable polymer is selected from a group consisting of polyethylene, polypropylene and VITON-A.

8. The method of claim 4 wherein the perfluorocarbon functional group is $SO_2X$, where X is a halide, and wherein the dispersion media includes at least one member of a group consisting of Halocarbon Oil, perfluorooctanoic acid, perfluorodecanoic acid, perfluorotributyl amine, perfluoro-11-methyl-decalin, decafluorobiphenyl, pentafluorophenol, and pentafluorobenzoic acid, and wherein the perfluorocarbon copolymer constitutes not greater than about 30 weight percent of the dispersion and wherein the dispersion is heated to between about 200° C. and 275° C.

9. A method for coating a substrate with a soluablized cross-linkable perfluorocarbon copolymer having pendant sulfonyl halide function groups and polymerized from at least two monomers, one such monomer consisting essentially of at least one fluorinated vinyl compound and the other monomer consisting essentially of at least one monomer having the structure:

$$CF_2{=}CFA,\ CF_2{=}CFR_1A,\ CF_2{=}CFOR_1A$$

with $R_1$ being a bifunctional perfluorinated radical having between 2 and 25 carbon atoms, which carbon atoms being at least once interruptable by one or more oxygen atoms and A being one of sulfonyl fluoride and sulfonyl chloride comprising the steps of:

dispersing the perfluorocarbon copolymer in a solvating dispersion media including at least one member of a group consisting of Halocarbon Oil, perfluorooctanoic acid, perfluorodecanoic acid, perfluorotributyl amine, perfluoro-1-methyl-decalin, decafluorobiphenyl, pentafluorophenol and pentafluorobenzoic acid, heating the dispersion to a temperature between about 200° C. and 275° C. whereby substantially all perfluorocarbon copolymer solvates;

dispersing at least one cross-linking initiator in a compatible dispersion media selected from the same group and heated to between about 200° C. and 275° C.;

admixing the dispersions immediately prior to application to the substrate;

applying the admixed dispersions to the substrate; and removing the dispersion media using at least one of heat and vacuum.

10. The method of claim 9 wherein the cross-linking initiator is selected from a group consisting of MgO, ethylenediamine carbamate, sodium disulfide, thiuramdisulfide, sulfur, dicumylperoxide.

11. The method of claim 9, a second cross-linkable polymer being dispersed with the perfluorocarbon copolymer.

12. The method of claim 11 wherein the second cross-linkable polymer is selected from a group consisting of polyethylene, polypropylene and VITON-A.

* * * * *